US005685159A

United States Patent [19]

Kooy et al.

[11] Patent Number: 5,685,159

[45] Date of Patent: Nov. 11, 1997

[54] METHOD AND SYSTEM FOR STORING COLD LIQUID

[75] Inventors: Richard J. Kooy, Western Springs; Don Henry Coers, Naperville, both of Ill.

[73] Assignee: Chicago Bridge & Iron Technical Services Company, Oak Brook, Ill.

[21] Appl. No.: 191,613

[22] Filed: Feb. 4, 1994

[51] Int. Cl.[6] ..... F17C 7/02

[52] U.S. Cl. ..... 62/50.1; 62/50.4; 62/48.1; 138/26; 220/749

[58] Field of Search ..... 62/48.1, 50.1, 62/50.4; 138/26; 220/749

[56] References Cited

U.S. PATENT DOCUMENTS

| | | | |
|---|---|---|---|
| 2,004,074 | 6/1935 | Kiley | 220/749 |
| 2,763,397 | 9/1956 | Rice | 220/749 |
| 3,097,498 | 7/1963 | Williams | 62/50.1 |
| 3,602,003 | 8/1971 | Hampton . | |
| 3,815,327 | 6/1974 | Viland | 220/749 X |
| 3,880,193 | 4/1975 | Lewis | 62/50.7 X |
| 3,967,465 | 7/1976 | Asselman et al. | 220/749 X |
| 4,122,684 | 10/1978 | Clarkson et al. | 220/749 X |
| 4,259,846 | 4/1981 | Rudolphi et al. | 220/749 X |
| 4,714,172 | 12/1987 | Morris | 220/749 X |
| 5,163,409 | 11/1992 | Gustafson et al. | 62/50.2 X |
| 5,404,918 | 4/1995 | Gustafson . | |
| 5,411,374 | 5/1995 | Gram . | |

FOREIGN PATENT DOCUMENTS

| | | | |
|---|---|---|---|
| 421838 | 1/1935 | United Kingdom | 220/749 |
| 462171 | 3/1937 | United Kingdom | 220/749 |

OTHER PUBLICATIONS

PCT/US 95/01453 International Search Report.

"Gram Integrated Fueling System," *LNG Express*, Jul./Aug. 1993, pp. 2–5.

National Fire Protection Association, *1994 Annual Meeting, Technical Committee Reports.*

National Fire Protection Association, *Standard For Liquefied Natural Gas, (LNG) Vehicular Fuel Systems*, May 1993.

"Recovery Danger: Using cylinders without high-level shutoff, overfill protection: A risk not worth taking," *Air Conditioning, Heating & Refrigeration News*, Apr. 1994.

Sporlan Valve Company, Level Master Control, Product Literature, Sep. 1990.

Alco Controls, Operating Principles and Application of the Thermostatic Expansion Valve, 1987.

Sporlan Valve Company, Thermostatic Expansion Valves with Selective Charges, Oct. 1981.

Alco Controls, Thermo Expansion Valves, May 1990.

Parker Refrigeration Components Group, Condensed Catalog Halocarbon Products.

National Fire Protection Association 59A, 1990 Edition.

*Primary Examiner*—Christopher Kilner

*Attorney, Agent, or Firm*—Marshall, O'Toole, Gerstein, Murray & Borun

[57] ABSTRACT

The present invention relates to a method and system for storing cold fluid. The system includes a main tank and an auxiliary tank that are in fluid communication, and the auxiliary tank receives vapor and expanding fluid as the cold fluid in the main tank warms thereby avoiding overpressurization of the system.

23 Claims, 3 Drawing Sheets

FIG. 4
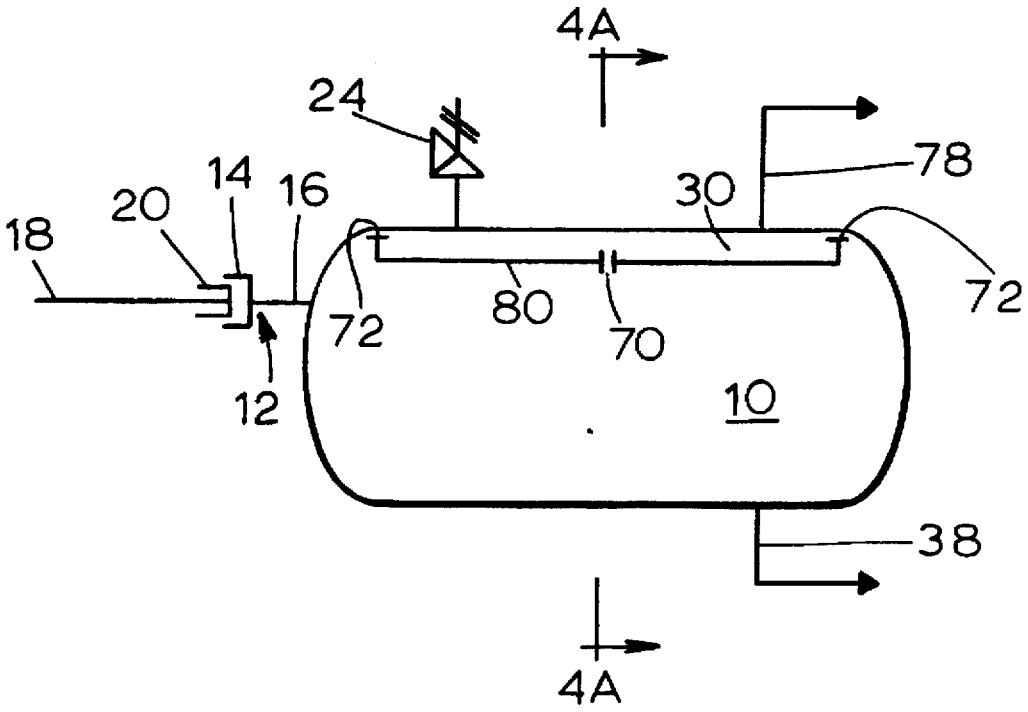
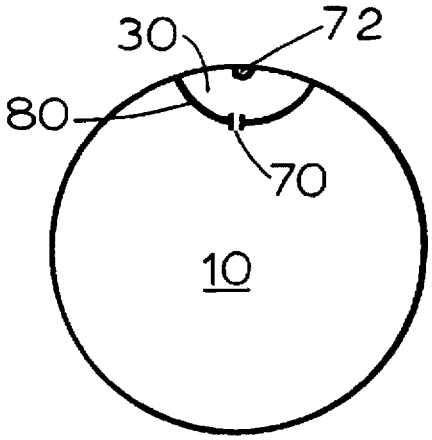
FIG. 4A

METHOD AND SYSTEM FOR STORING COLD LIQUID

BACKGROUND OF THE INVENTION

This invention relates generally to cold fluid storage tanks and particularly to a system for storing cold fluid that includes a main tank for receiving cold fluid and an auxiliary tank for receiving vapor and expanding fluid from the main tank as the cold fluid warms, thereby preventing overpressurization of the system.

Tanks for storing cold liquids can be used in vehicles or they may be stationary. Typically, cold liquid storage tanks are double-walled or insulated or both to reduce the rate of warming the stored liquid. Nevertheless, after prolonged exposure to ambient conditions the tank will leak heat to its contents. When cold liquids such as liquefied natural gas are stored at −260° F. and then are warmed even slightly, they tend to both expand in the liquid phase and vaporize which increases the volume of the liquid and raises the pressure inside the tank.

In order to prevent the internal pressure of a storage tank from rising to dangerously high levels, some means must be used for providing a minimum tank ullage at the time of filling that can accommodate the subsequent increase in internal pressure. The 1990 edition of the National Fire Protection Association, Inc. Standard for the Production, Storage, and Handling of Liquefied Natural Gas (NFPA 59A) includes paragraph 4-1.6 on Filling Volume of liquefied natural gas storage tanks and an accompanying FIG. 4-1, that an operator can use to determine the maximum filling volume to avoid overfilling. For example, using this chart an operator can determine that a tank with a vapor relief valve setting of 65 psig and tank pressure after filling of 20 psig, can be filled to a maximum 94.3 percent capacity by volume. The 5.7 percent ullage space can then accommodate expanding liquid and increased vapor pressure to avoid overpressurization of the tank.

Not all tanks are provided with accurate means for determining tank volume and not all operators will have the necessary skill to apply the principles of FIG. 4-1 for a variety of tanks. Errors can occur in assessing internal pressure at filling and confirming pressure relief valve specifications. Further, intentional or negligent failure to abide by NFPA standards is a possibility since enforcement can be difficult and costly.

NFPA 59A also includes paragraph 4-8 requiring provision for maintaining internal pressure and vacuum of liquefied natural gas tanks by releasing or admitting gas as needed. Pressure relief valves are helpful in preventing overpressurization of a tank, but result in the wasteful escape of liquefied natural gas to the atmosphere. Thus, a means for controlling the volume of liquid at the time a tank is filled will minimize waste and maximize safety.

SUMMARY OF THE INVENTION

The present invention provides a means for supplementing a main storage tank with an auxiliary tank to accommodate expanding liquid and the vapor. The auxiliary tank is typically smaller than the main storage tank and it has a volume of predetermined size sufficient to accommodate vapor and overflow of expanding cold fluid from the main tank to prevent overpressurization of both tanks.

Therefore, a cold fluid storage system in accordance with the present invention includes a main tank having means for receiving cold liquid, an auxiliary tank in fluid communication with the main tank, the auxiliary tank having means for receiving expanding cold fluid and vapor from the main tank as the cold fluid warms, and means for controlling flow of cold fluid into the auxiliary tank when the main tank is receiving cold fluid. The means for controlling flow between the main tank and the auxiliary tank may include a solenoid valve to prevent flow or it may include a capillary tube to restrict flow.

There may also be included an interlock sensor having means for activating the means for controlling the flow of fluid into the auxiliary tank when the main tank is receiving cold fluid.

The cold fluid storage system may have means for withdrawing vapor from the auxiliary tank or the main tank or both. The cold fluid storage system may also have means for withdrawing cold fluid from the main tank or from the auxiliary tank or from both. The cold fluid may be primarily liquid but may have substantial amounts of entrained vapor as well.

The cold fluid storage system may also have means for draining the auxiliary tank into the main tank by gravity. The main tank may be at least partially insulated or of double-walled construction to reduce the rate of warming of the stored liquid.

An alternative embodiment of a cold fluid storage tank includes a main tank having means for receiving cold fluid, an auxiliary tank positioned inside of the main tank, the auxiliary tank having means for receiving expanding cold fluid and vapor from the main tank, and means for controlling flow of cold fluid into the auxiliary tank when the main tank is receiving cold fluid. The means for controlling flow of cold fluid may include a capillary tube.

The present invention is also directed to a method for storing cold fluid including providing a main storage tank for receiving cold fluid, providing an auxiliary tank for receiving vapor and expanding cold fluid from the main tank as the cold fluid warms, filling the main tank with cold fluid and simultaneously controlling the flow of fluid and vapor to the auxiliary tank, and enabling cold liquid and vapor to flow into the auxiliary tank after the main tank is substantially filled to capacity. The step of controlling the flow of fluid and vapor to the auxiliary tank may include closing a valve or restricting the flow with a capillary tube.

BRIEF DESCRIPTION OF THE DRAWINGS

FIG. 4 is a schematic of another alternate embodiment of a cold fluid storage system in accordance with the present invention; and FIG. 4A is a cross-sectional view of the cold fluid storage tank of FIG. 4 take along line 4A—4A.

DETAILED DESCRIPTION OF THE DRAWINGS

To the extent reasonable and possible, the same numerals will be used to identify identical components in each of the Figures described hereinafter.

Figure 1:
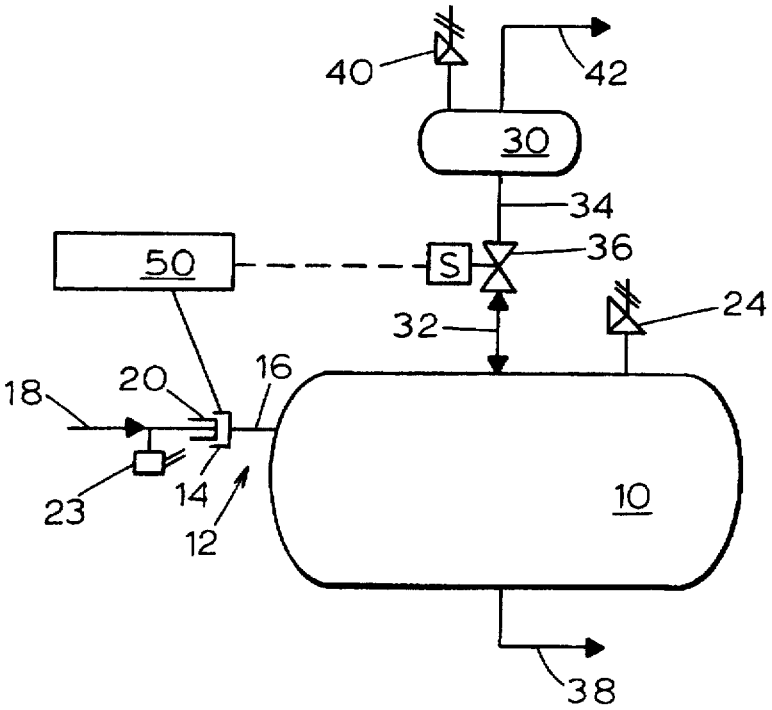
FIG. 1 is a schematic of a cold fluid storage system in accordance with the present invention.

Illustrated in FIG. 1 is a main storage tank 10 for receiving and storing a cold liquid product, such as liquefied natural gas at temperatures as low as −270° F. Liquefied hydrogen and other cryogens may also be stored in such a device. Main tank 10 may be stationary or mounted in a vehicle and is preferably double-walled or insulated or both to reduce the rate of temperature rise of the stored liquid product. Insulation may keep the stored liquid cool long enough so that withdrawal of the liquid or vapor for fueling engines or transfer to some other type of container will provide the necessary ullage for receiving expanding cold liquid and vapor. Nevertheless, safety regulations dictate that some means be provided to accommodate or reduce rising tank pressure. The present invention can accommodate increased tank pressure from a main tank filled to capacity by providing an auxiliary storage volume into which the fluid can expand. Thus, skilled operators are not necessary and enforcement of safety regulations is possible by inspection of tanks which avoids the necessity of on site inspectors for the filling process.

Main tank 10 is provided with means for receiving cold liquid 12 illustrated on the upper left end of main tank 10. Means for receiving a cold liquid 12 includes a normally closed shut-off coupling 14 and a conduit 16 positioned between shut-off coupling 14 and main tank 10. Shut-off coupling 14 may be equipped with means to be automatically opened when it is engaged by a source 18 having a coupling 20 that feeds cold liquid under pressure to main tank 10 through coupling 14 and conduit 16. A back pressure switch 23 is also provided in source 18 near coupling 20 that will shut off the flow of fluid when main tank 10 reaches capacity and applies a back pressure. Main tank 10 is fitted with a main pressure relief valve 24 in its top to vent vapor when internal pressure exceeds a predetermined value.

An auxiliary tank 30 is provided and illustrated above main tank 10. Auxiliary tank 30 is in fluid communication with main tank 10 through conduits 32 and 34. A valve 36 is positioned between conduits 32 and 34 to selectively control the flow of fluid, either liquid or vapor, between main tank 10 and auxiliary tank 30. Auxiliary tank 30 is fitted with an auxiliary pressure relief valve 40 in its top to vent vapor when internal pressure exceeds a predetermined value. It is desirable that neither pressure relief valve 24 and 40 ever be necessary since most of the vaporized tank contents are retained in auxiliary tank 30 and may be recovered through optional vapor conduit 42.

Auxiliary tank 30 is preferably double-walled and insulated, and sized to accommodate expansion of liquid and vapor stored in main tank 10. The size of auxiliary tank 30 can be determined using criteria such as FIG. 4-1 of NFPA 59A plus an additional safety factor where necessary.

In operation, cold liquid such as liquefied natural gas is fed to main tank 10 from source 18. Main tank 10 is filled to capacity and overflow into auxiliary tank 30 is prevented by closing valve 36. When main tank 10 reaches capacity, a back pressure is applied to back pressure switch 23 and flow is cut off. Limiting overflow into auxiliary tank 30 while filling main tank 10 is desirable to ensure that the entire volume of auxiliary tank 30 is available to receive fluid from main tank 10 and thus avoid overpressurization of main tank 10.

Once main tank 10 is filled to capacity and coupling 20 is disengaged from coupling 14, valve 36 is opened either manually or automatically, and auxiliary tank 30 operates at the same pressure as main tank 10. Auxiliary tank 30 will begin receiving vapor immediately and will receive fluid as the liquid in main tank 10 begins to warm. Any liquid that enters auxiliary tank 30 during operations will drain by gravity to main storage tank 10 as liquid is withdrawn through conduit 38. The liquid that is withdrawn may have substantial amounts of entrained vapor. Vapor can be recovered by being withdrawn from the tanks 10 and 30 through vapor conduit Valve 36 is preferably a solenoid valve to enable automatic opening and closing of valve 36 depending upon whether main tank receiving means shut-off coupling 14 is engaging a source coupling 20. When shut-off coupling 14 is engaged, solenoid valve 36 will close because an interlock sensor 50 will sense the coupling and send an activating electrical current to close valve 36. When couplings 14 and 20 are disengaged interlock sensor 50 stops supplying an activating electrical current to valve 36 which allows valve 36 to return to a normally open position which enables the flow of vapor and liquid between the tanks.

Figure 2:
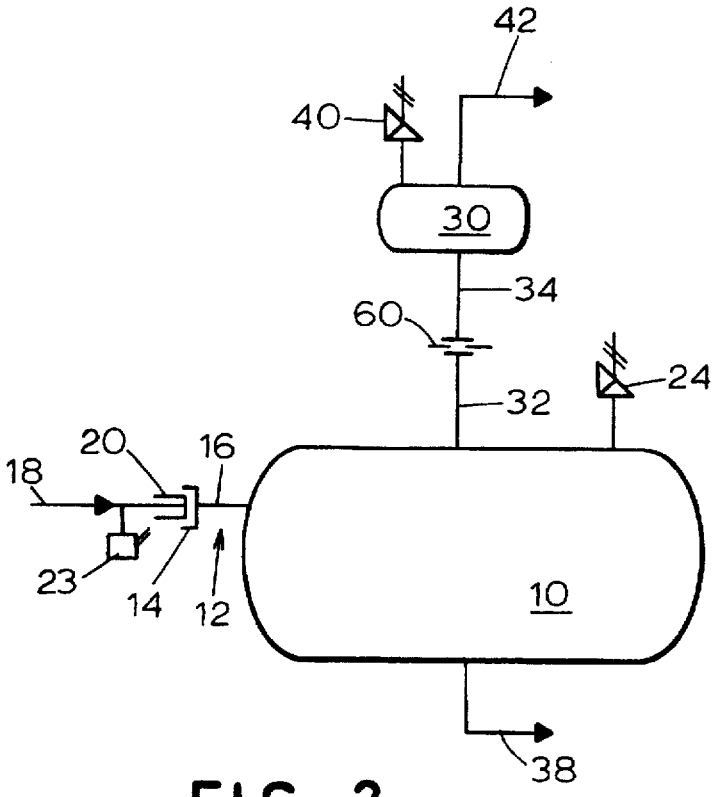
FIG. 2 is a schematic of an alternate embodiment of a cold fluid storage system in accordance with the present invention.

FIG. 2 illustrates an alternate embodiment of the invention which includes a main tank 10, means 12 for receiving cold liquid into main tank 10, a source of cold liquid 18, a main tank vent 24, and an auxiliary tank 30 having a vent 40 and a vapor withdrawing conduit 42.

The primary difference between the apparatus of FIG. 1 and FIG. 2 is the element between conduit 32 and conduit 34 which communicates with main tank 10 and auxiliary tank 30. Whereas FIG. 1 depicts an active valve 36, FIG. 2 depicts a passive capillary tube 60 which represents any flow restricting device that has a flow rate capacity substantially less than the means for receiving cold liquid 12.

In this apparatus, main tank 10 can be filled to capacity relatively rapidly and auxiliary tank 30 will receive only an inconsequential amount of cold liquid because auxiliary tank 30 is preferably positioned above main tank 10 and cannot receive liquid until main tank 10 is at capacity. Further, capillary tube 60 will control flow of fluid to auxiliary tank 30 by restricting it to such a degree as to apply a back pressure to receiving means 12 and pressure switch 23 which will shut off flow from source 18, resulting in main tank 10 being filled to capacity and auxiliary tank 30 being substantially empty.

As liquid stored in main tank 10 warms, expands and vaporizes, auxiliary tank 30 will be able to receive liquid through capillary tube 60 due to its relatively slow rate of expansion. As main tank 10 is emptied in normal use, liquid in auxiliary tank 30 will flow back to main tank 10 due to gravity. Vapor can be removed and recovered from auxiliary tank 30 through vapor conduit 42. Thus, all of the advantages of using auxiliary tanks as a means to relieve cold liquid storage tank pressure can be realized using passive means for controlling fluid flow to auxiliary tank 30 during main tank 10 filling. This results in reduced initial capital expenditures and lifetime maintenance costs for a very reliable system.

Figure 3:
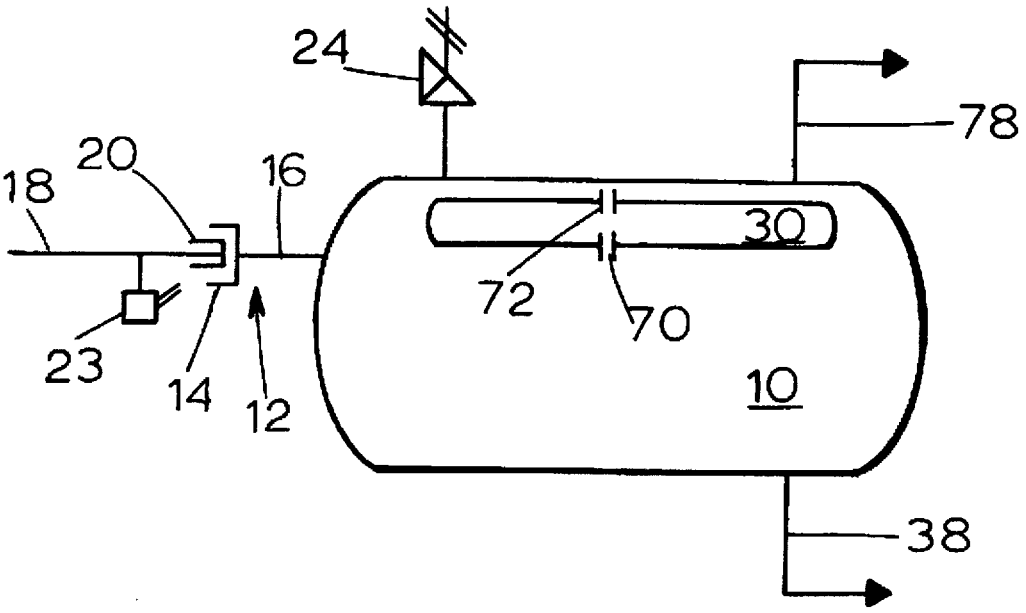
FIG. 3 is a schematic of another alternate embodiment of a cold fluid storage system in accordance with the present invention.

FIG. 3 illustrates yet another embodiment of the invention which is more compact than the above-described embodiments and includes the advantages of passive flow control between main tank 10 and auxiliary tank 30.

As illustrated, this apparatus includes a main tank 10, means for receiving cold liquid 12, a cold liquid source 18, a main tank vent 24, and an auxiliary tank 30 positioned inside of main tank 10 and is preferably mounted above the bottom of main tank 10. Auxiliary tank 30 is illustrated in FIG. 3 as a separate tank, but it may simply be a cavity in main tank 10 formed by a partition 80 or other suitable means, as illustrated in FIG. 4 and FIG. 4A. Auxiliary tank 30 includes a lower capillary tube 70 and an optional upper capillary tube 72. It should be understood that any means for controlling flow by restricting or preventing liquid from entering auxiliary tank 30 will achieve the desired function of capillary tubes 70 and 72.

In this embodiment, main tank 10 is filled as described above. Flow of cold liquid into auxiliary tank 30 is restricted by lower capillary tube 70 once liquid in main tank 10 reaches that elevation. Likewise, flow of liquid into auxiliary tank 30 is restricted by upper capillary tube 72 when liquid in main tank 10 reaches that elevation. Upper and lower capillary tubes 70 and 72 will prevent substantial amounts of cold liquid from entering auxiliary tank 30 while main tank 10 is being filled and also provide fluid communication between main tank 10 and auxiliary tank 30 as stored liquid slowly warms, expands and vaporizes. As described above, the flow restriction through capillary tubes 70 and 72 will cause a back pressure to be applied to receiving means 12 and source 18, which can be sensed by back pressure switch 23 and flow from source 18 will be shut off.

Liquid that collects in auxiliary tank 30 during operation drains by gravity through lower capillary tube 70 back into main tank 10 as liquid is withdrawn through conduit 38. Vapor that collects in auxiliary tank 30 escapes through upper capillary tube 72 when present and may be withdrawn from main tank 10 through vapor conduit 78. Thus, the apparatus is passive, reliable and compact, and functions to restrict the maximum amount of liquid that can be filled into main tank 10 while providing adequate volume for expansion of stored cold fluids.

Approximate sizes for capillary tubes in any of the above-described embodiments can be determined by one of ordinary skill in the art based on flow rate into main tank 10 from source 18, size of main tank 10, size of auxiliary tank 30, viscosity of the stored cold fluid, and required capacity of auxiliary tank 30 at the time main tank 10 is filled so as to achieve the desired results.

It should be understood that modifications and variations of the above-described embodiments will present themselves to those skilled in the art without departing from the scope of the invention as claimed below.

What is claimed is:

1. A cold fluid storage system comprising:

(a) a main storage tank having means for receiving cold fluid until back pressure is applied;

(b) an auxiliary tank in fluid communication with the main storage tank, the auxiliary tank having communicating means, the communicating means having means for receiving cold fluid and vapor from the main storage tank as the cold fluid warms and expands and, means for controlling flow of cold fluid into the auxiliary tank when the main tank is receiving cold fluid and for applying back pressure to the receiving means when the main tank is substantially full.

2. The cold fluid storage system of claim 1 in which the means for controlling flow of cold fluid into the auxiliary tank when the main tank is receiving cold fluid comprises a valve.

3. The cold fluid storage system of claim 1 in which the means for controlling flow of cold fluid into the auxiliary tank when the main tank is receiving cold fluid comprises a capillary tube.

4. The cold fluid storage system of claim 1 in which the means for controlling flow of cold fluid into the auxiliary tank when the main tank is receiving cold fluid comprises an orifice.

5. The cold fluid storage system of claim 1 and further comprising:

an interlock sensor having means for activating the means for controlling flow of cold fluid into the auxiliary tank when the main tank is receiving cold fluid.

6. The cold fluid storage system of claim 1 and further comprising:

means for withdrawing vapor from the auxiliary tank.

7. The cold fluid storage system of claim 1 in which the communicating means includes means for draining cold fluid from the auxiliary tank into the main tank by gravity.

8. The cold fluid storage system of claim 1 and further comprising:

means for withdrawing vapor from the main tank.

9. A cold fluid storage system comprising:

(a) a main tank having means for receiving cold fluid until back pressure is applied; and (b) an auxiliary tank positioned inside the main storage tank, the auxiliary tank having communicating means, the communicating means having means for receiving expanding cold fluid from the main tank, means for controlling flow of cold fluid into the auxiliary tank when the main tank is receiving cold fluid, means for applying back pressure to the receiving means when the main tank is substantially full, and means for draining cold fluid from the auxiliary tank to the main tank by gravity.

10. The cold fluid storage system of claim 9 in which the means for controlling flow of cold fluid into the auxiliary tank when the main tank is receiving cold fluid comprises a valve.

11. The cold fluid storage system of claim 9 in which the means for controlling flow cold fluid into the auxiliary tank when the main tank is receiving cold fluid comprises a capillary tube.

12. The cold fluid storage system of claim 9 in which the means for controlling flow of cold fluid into the auxiliary tank when the main tank is received cold fluid comprises an orifice.

13. The cold fluid storage system of claim 9 in which the means for receiving expanding cold fluid from the main tank is located near the top of the inside of the main storage tank.

14. The cold fluid storage system of claim 9 and further comprising:

means for withdrawing vapor from the auxiliary tank.

15. The cold fluid storage system of claim 9 and further comprising:

means for withdrawing cold fluid from the main tank.

16. The cold fluid storage system of claim 9 and further comprising:

means for withdrawing cold fluid from the auxiliary tank.

17. A method for storing cold fluid comprising the steps of:

(a) providing a main storage tank for receiving cold fluid;

(b) providing an auxiliary volume for receiving expanding cold fluid from the main tank as the cold fluid warms;

(c) filling the main storage tank with cold fluid until back pressure is sensed, and simultaneously controlling the flow of fluid to the auxiliary tank thereby applying a back pressure to stop filling the main storage tank when the main storage tank is substantially full;

(d) enabling flow of cold fluid into the auxiliary tank after the main tank is substantially filled to capacity; and (e) draining cold fluid from the auxiliary volume into the main storage tank by gravity as cold fluid is withdrawn from the main tank.

18. The method of claim 17 in which the step of controlling the flow of cold fluid to the auxiliary tank includes closing a valve.

19. The method of claim 17 in which the step of controlling the flow of cold fluid to the auxiliary tank includes restricting the flow of cold fluid to the auxiliary tank with a capillary tube.

20. The method of claim 17 in which the step of controlling the flow of cold fluid to the auxiliary tank includes restricting the flow of cold fluid to the auxiliary tank with an orifice.

21. The method of claim 17 and further comprising the step of:

withdrawing vapor from the auxiliary tank.

22. The cold fluid storage system of claim 9 in which the auxiliary tank is defined at least partially by a partition within the main tank.

23. The cold fluid storage system of claim 1 wherein the bottom of the auxiliary tank is located at an elevation above the elevation of the bottom of the main storage tank and the communicating means includes means for draining cold fluid from the auxiliary tank into the main tank by gravity.

* * * * *